US010219634B2

(12) United States Patent
Yang

(10) Patent No.: US 10,219,634 B2
(45) Date of Patent: Mar. 5, 2019

(54) SUPPORTING APPARATUS FOR A CRIB

(71) Applicant: Shu-Chen Wang, Zhongshan, GuangDong (CN)

(72) Inventor: Cheng-Fan Yang, Tainan (TW)

(73) Assignee: B & B BEST INDUSTRIAL CO., LTD., Taipei (TW)

( * ) Notice: Subject to any disclaimer, the term of this patent is extended or adjusted under 35 U.S.C. 154(b) by 610 days.

(21) Appl. No.: 14/984,263

(22) Filed: Dec. 30, 2015

(65) Prior Publication Data

US 2016/0198864 A1 Jul. 14, 2016

(30) Foreign Application Priority Data

Jan. 12, 2015 (CN) ..... 2015 2 0019317 U

(51) Int. Cl.
*A47D 9/00* (2006.01)
*A47D 15/00* (2006.01)

(52) U.S. Cl.
CPC ..... *A47D 9/00* (2013.01); *A47D 15/00* (2013.01)

(58) Field of Classification Search
CPC . A47D 7/01; A47D 9/00; A47D 13/06; A47D 15/00; A61G 7/012; A61G 13/06; A47B 9/00; A47B 9/20; A47B 17/02; A47B 21/02; B66F 11/04; B66F 11/044; B66F 11/046; E04G 1/20; E04G 1/22
USPC ..... 5/655, 93.1, 95, 98.1, 99.1, 11, 611; 108/147, 144.11; 182/141, 142, 145, 146, 182/148
See application file for complete search history.

(56) References Cited

U.S. PATENT DOCUMENTS 394,781 A * 12/1888 Maurer ..... E04G 5/04 182/229
1,307,610 A * 6/1919 Yeagley ..... A47B 57/567 182/148
3,071,205 A * 1/1963 Beck, Jr. ..... E04G 1/20 182/146
4,294,332 A * 10/1981 Ready ..... E04G 1/20 182/132
4,924,332 A * 5/1990 Dwyer ..... G11B 27/28 360/137
4,967,733 A * 11/1990 Rousseau ..... B66F 11/04 182/13
5,310,018 A * 5/1994 Lahaie ..... B66F 11/04 182/113

(Continued)

FOREIGN PATENT DOCUMENTS

EP 3042589 A1 * 7/2016 ..... A47D 15/00
EP 3042589 B1 * 6/2018 ..... A47D 15/00

*Primary Examiner* — Robert G Santos
(74) *Attorney, Agent, or Firm* — Rabin & Berdo, P.C.

(57) ABSTRACT

A supporting apparatus for a crib has two legs and a frame. Each leg has a rack. The frame is moveably mounted between the legs and has a body, two moving seats and two adjustment members. The moving seats are mounted on the body, and the legs are inserted into the moving seats respectively. The adjustment members are mounted on the moving seats respectively and engage with the racks of the legs respectively, and each adjustment member is rotatable and moveable upward and downward along a corresponding one of the racks of the legs. The supporting apparatus can be steplessly adjusted to adjust the height of a bed surface of the crib to improve safety.

15 Claims, 12 Drawing Sheets

(56) References Cited

U.S. PATENT DOCUMENTS

| | | | | |
|---|---|---|---|---|
| 5,636,394 | A * | 6/1997 | Bartley | A47C 19/045 108/10 |
| 6,502,667 | B1 * | 1/2003 | Mead | B66F 7/14 187/214 |
| 7,086,632 | B2 * | 8/2006 | Hsieh | G10H 1/32 108/147 |
| 8,167,089 | B2 * | 5/2012 | Castle | E04G 1/20 182/141 |
| 2005/0230574 | A1 * | 10/2005 | Hsieh | G10H 1/32 248/163.1 |
| 2009/0178883 | A1 * | 7/2009 | Castle | E04G 1/20 182/19 |
| 2016/0198864 | A1 * | 7/2016 | Yang | A47D 15/00 5/655 |
| 2018/0317645 | A1 * | 11/2018 | Stoelinga | A47B 9/06 |

* cited by examiner

SUPPORTING APPARATUS FOR A CRIB

BACKGROUND OF THE INVENTION

1. Field of the Invention

The present invention relates to a supporting apparatus for a crib, and more particularly to a supporting apparatus provided for steplessly adjusting the height of a bed surface of the crib.

2. Description of Related Art

A conventional supporting apparatus for a crib has two legs and a frame. Each leg has a transverse rod, a longitudinal rod and two fixing members. A bottom end of the longitudinal rod is connected to the middle of the transverse rod. The fixing members are symmetrically mounted in the longitudinal rod. Each fixing member has a button and a spring. The button is moveably mounted in the longitudinal rod and protrudes out of the longitudinal rod. The spring is mounted in the longitudinal rod. Two ends of the spring are connected to the button and the longitudinal rod respectively. The frame is moveably mounted on the legs. The frame has two tubes. The tubes are mounted on the longitudinal rods respectively. Each tube has multiple holes. The buttons of the fixing members protrude through the holes of the tubes selectively to adjust the height of a bed surface of the crib.

Furthermore, a curtain can be mounted on the frame of the supporting apparatus. The crib can be put on a side of an adult bed. The curtain is opened to form an opening that faces the adult bed. The height of the bed surface of the crib is adjusted by the fixing members of the supporting apparatus to be close to the height of a bed surface of the adult bed. Therefore, babies can safely move between the crib and the adult bed via the opening.

The height adjustment by the fixing members of the supporting apparatus is operated according to preset steps or stages. After the height of the bed surface of the crib is adjusted by the fixing members of the supporting apparatus, height difference between the bed surface of the crib and the bed surface of the adult bed cannot be completely eliminated. Therefore, babies moving between the crib and the adult bed may be exposed to danger. In addition, the bottom end of the longitudinal rod is connected to the middle of the transverse rod, and the supporting fulcrum of the supporting apparatus is located at the middle of the transverse rod. When the weight loaded on the supporting apparatus is diverged from the supporting fulcrum of the supporting apparatus, the supporting apparatus is prone to topple.

To overcome the shortcomings, the present invention tends to provide a supporting apparatus for a crib to mitigate or obviate the aforementioned problems.

SUMMARY OF THE INVENTION

The main objective of the invention is to provide a supporting apparatus for a crib that can steplessly adjust the height of a bed surface of the crib.

The supporting apparatus for a crib has two legs and a frame. Each leg has a rack. The frame is moveably mounted between the legs and has a body, two moving seats and two adjustment members. The moving seats are mounted on the body, and the legs are inserted into the moving seats respectively. The adjustment members are mounted on the moving seats respectively and engage with the racks of the legs respectively, and each adjustment member is rotatable and moveable upward and downward along a corresponding one of the racks of the legs.

The supporting apparatus for a crib can be put on a side of an adult bed. The adjustment members are rotated along the racks of the legs, and then the adjustment members move upward and downward along the racks of the legs. Therefore, the height of the bed surface of the crib is adjusted by the adjustment members of the supporting apparatus to fit bed surfaces of adult beds of various heights. The height of the bed surface of the crib and the height of the bed surface of the adult bed are adjusted to be the same. Therefore, babies moving between the crib and the adult bed are safe.

Each leg of the supporting apparatus further has a first supporting member. The first supporting member has a first supporting portion and a second supporting portion. A bottom end of the second supporting portion is connected to the first supporting portion. The rack of the leg is mounted on the second supporting portion. In addition, the first supporting portion has a transverse portion, and the second supporting portion has a slanting portion. The slanting portion is integrally connected to an end of the transverse portion and has a concave surface and a convex surface. Each leg has a second supporting member mounted on the transverse portion of the leg and protruding from the convex surface of the slanting portion of the leg.

The supporting fulcrum of the supporting apparatus is located at the junction between the transverse portion and the slanting portion. When the weight loaded on the supporting apparatus is diverged from the supporting fulcrum of the supporting apparatus, the supporting apparatus would not topple and is safe in use.

Other objects, advantages and novel features of the invention will become more apparent from the following detailed description when taken in conjunction with the accompanying drawings.

DETAILED DESCRIPTION OF PREFERRED EMBODIMENT

Figure 1:
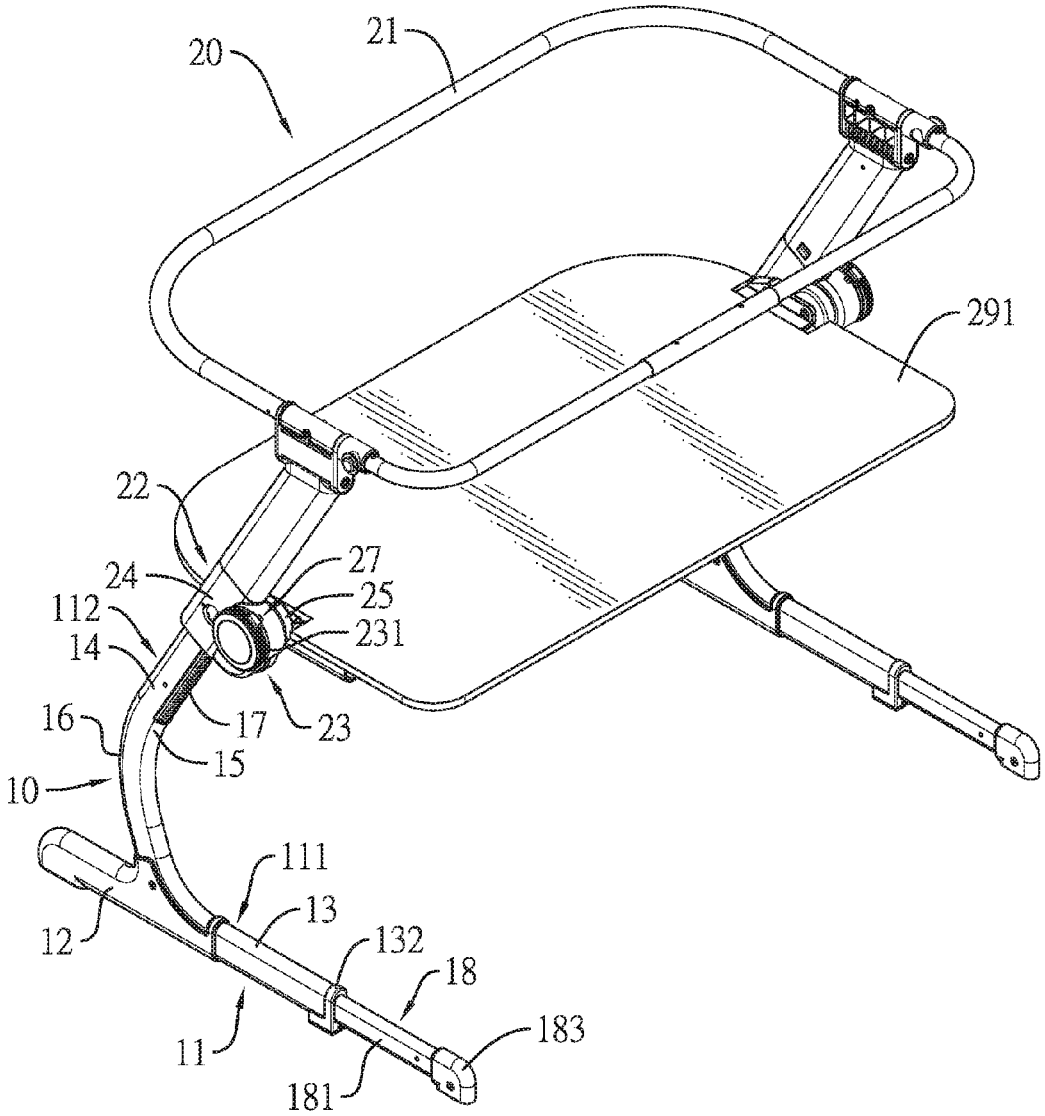
FIG. 1 is a perspective view of a supporting apparatus for a crib in accordance with the present invention.
Figure 2:
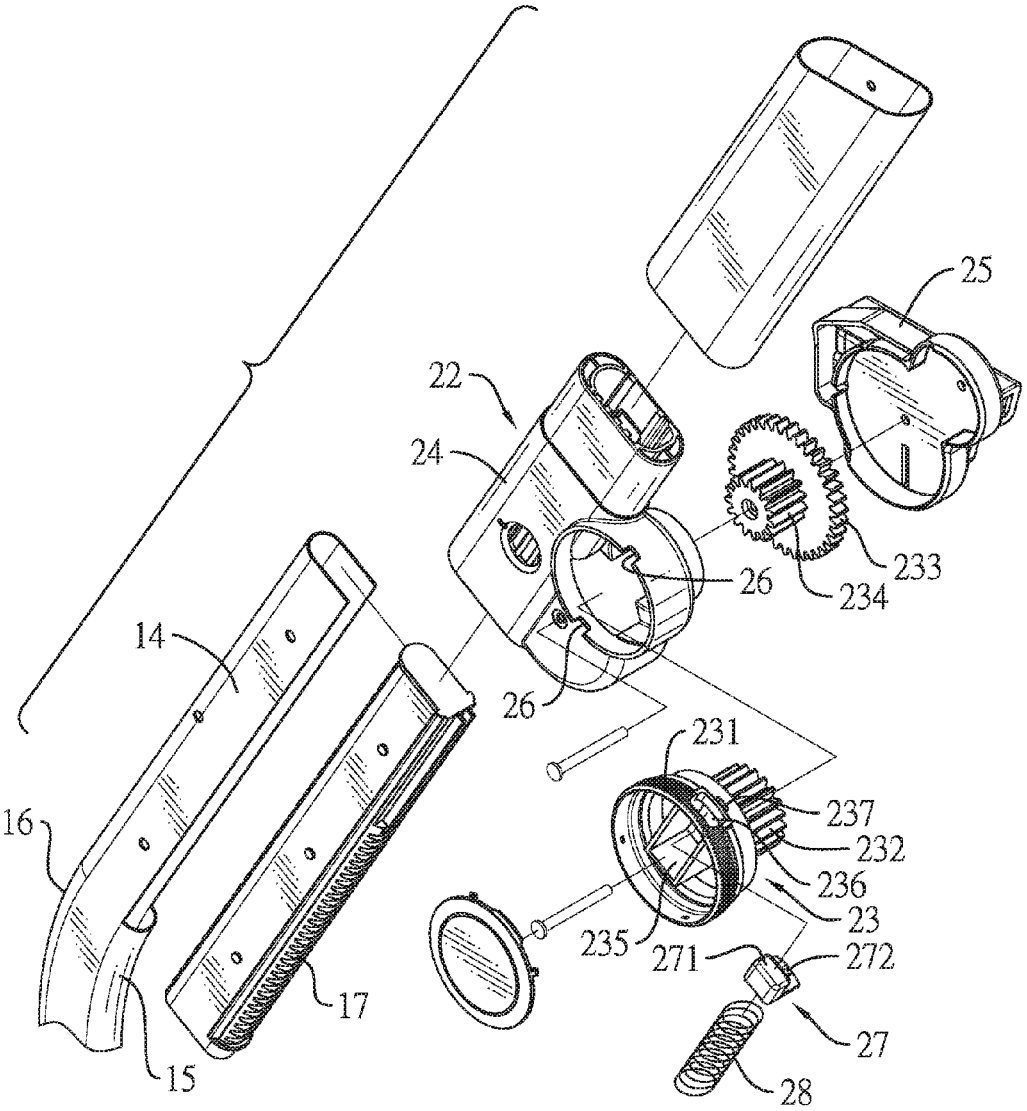
FIG. 2 is an enlarged exploded perspective view of the supporting apparatus in FIG. 1.
Figure 3:
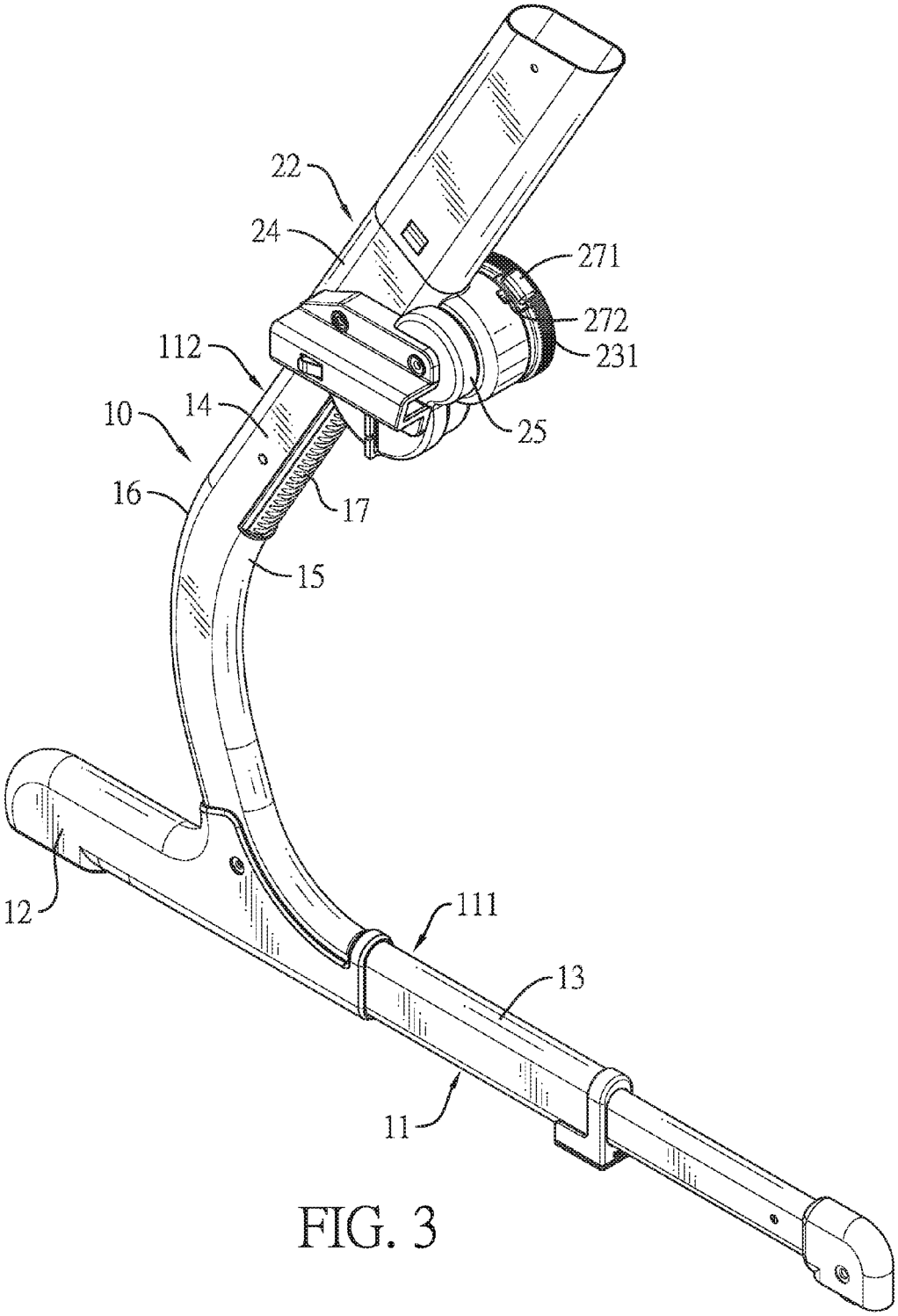
FIG. 3 is an enlarged partial perspective view of the supporting apparatus in FIG. 1.

With reference to FIGS. 1 to 3, a supporting apparatus for a crib in accordance with the present invention comprises two legs 10 and a frame 20.

Figure 11:
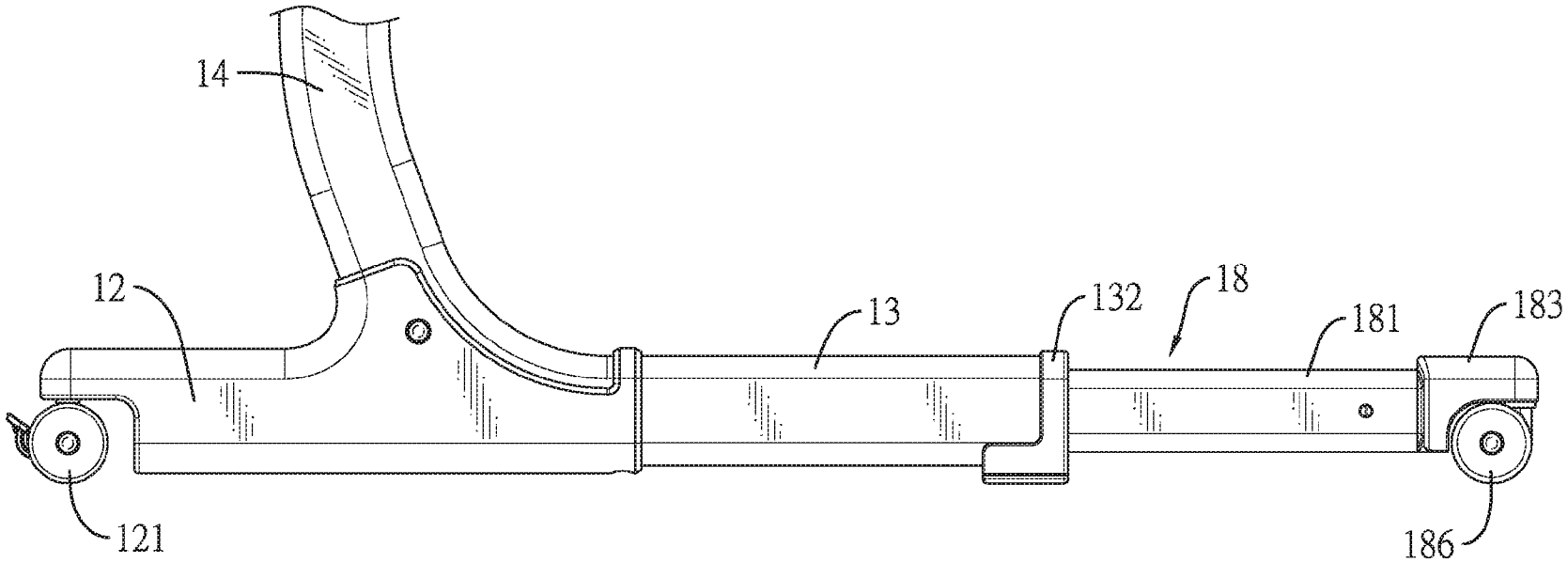
FIG. 11 is a side view of another embodiment of a supporting apparatus for a crib in accordance with the present invention, combined with a braking caster and a second supporting member.

Each leg 10 has a first supporting member 11 and a rack 17. The first supporting member 11 has a first supporting portion 111 and a second supporting portion 112. A bottom end of the second supporting portion 112 is connected to the first supporting portion 111. The rack 17 is mounted on the second supporting portion 112. Furthermore, the first supporting portion 111 has a transverse portion 13, and the second supporting portion 112 has a slanting portion 14. The slanting portion 14 is integrally connected to an end of the transverse portion 13 and has a concave surface 15 and a convex surface 16. Each leg 10 has a second supporting member 12, and the second supporting member 12 is mounted on the transverse portion 13 of the leg 10 and protrudes from the convex surface 16 of the slanting portion 14 of the leg 10. With reference to FIG. 11, each leg 10 has a braking caster 121. The braking caster 121 is mounted on the second supporting member 12.

Figure 4:
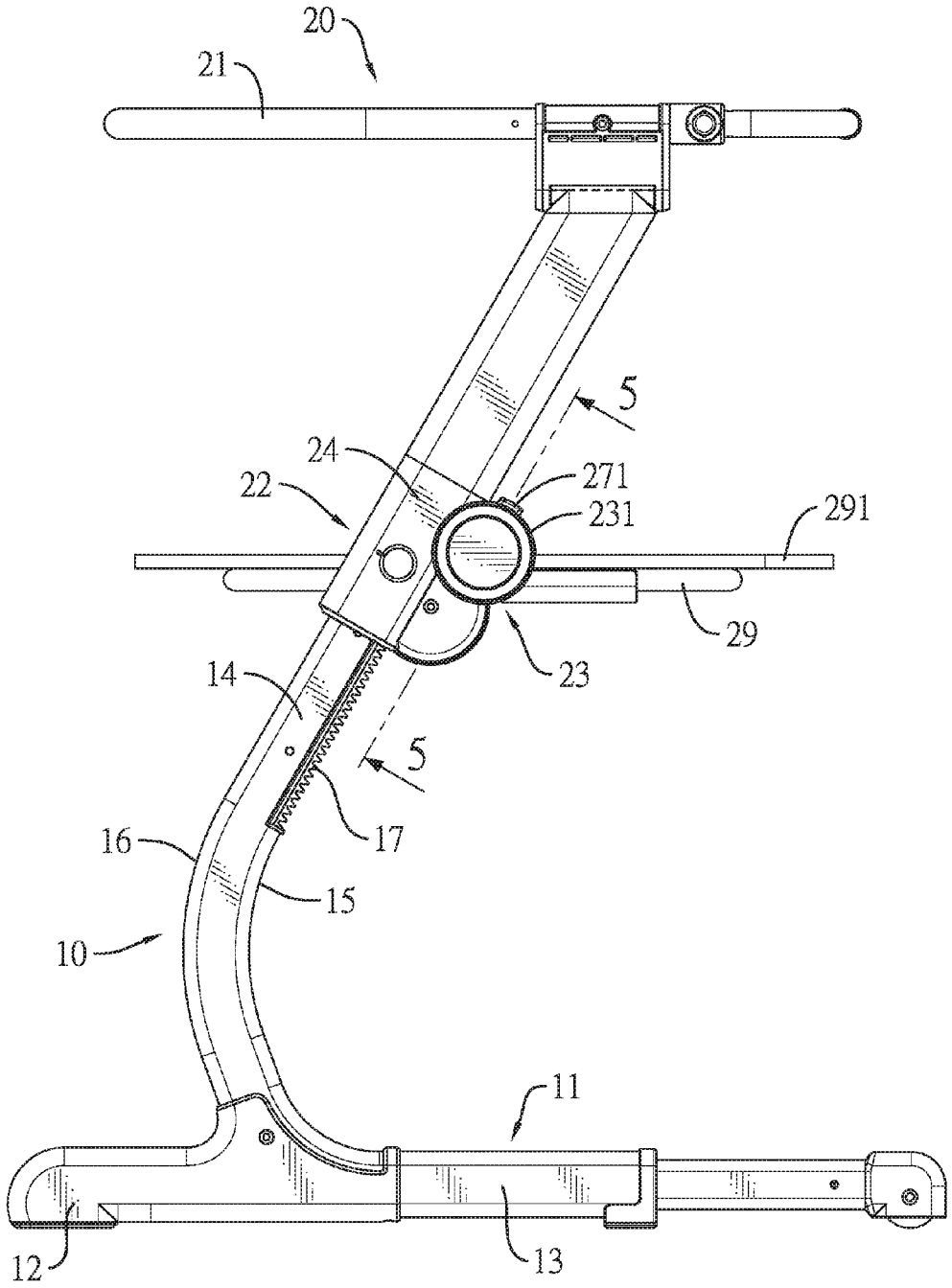
FIG. 4 is a side view of the supporting apparatus in FIG. 1.
Figure 5:
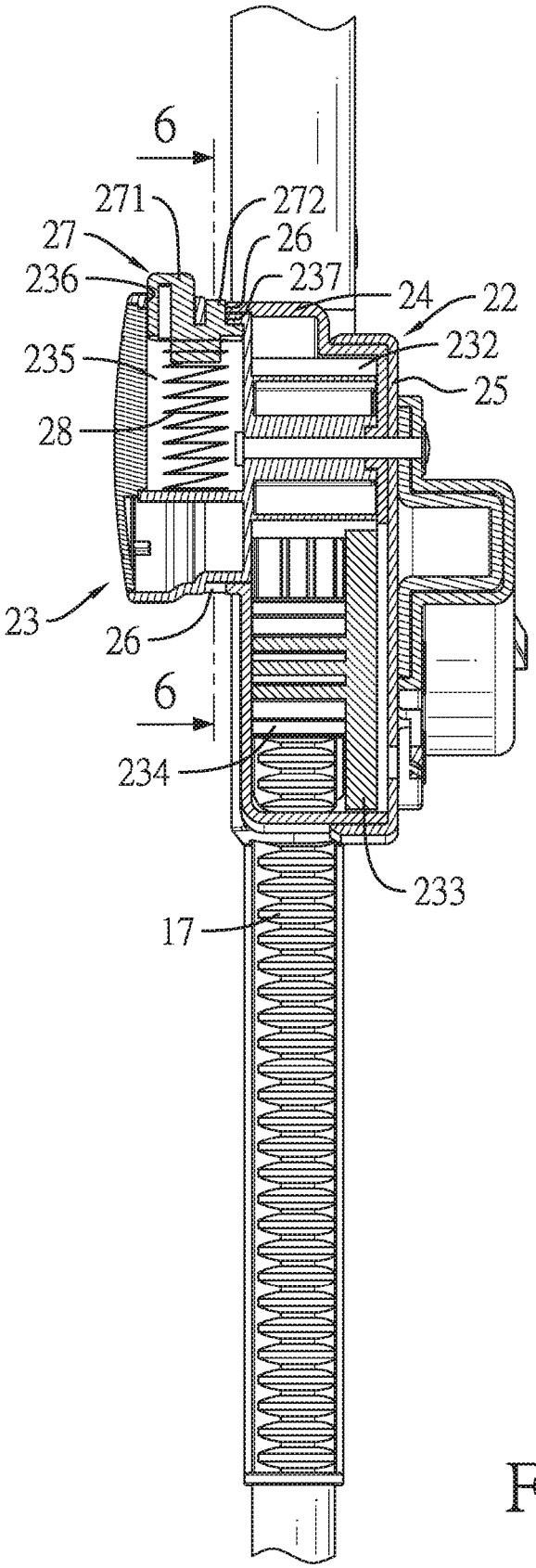
FIG. 5 is an end view in partial section of the supporting apparatus along line 5-5 in FIG. 4.
Figure 6:
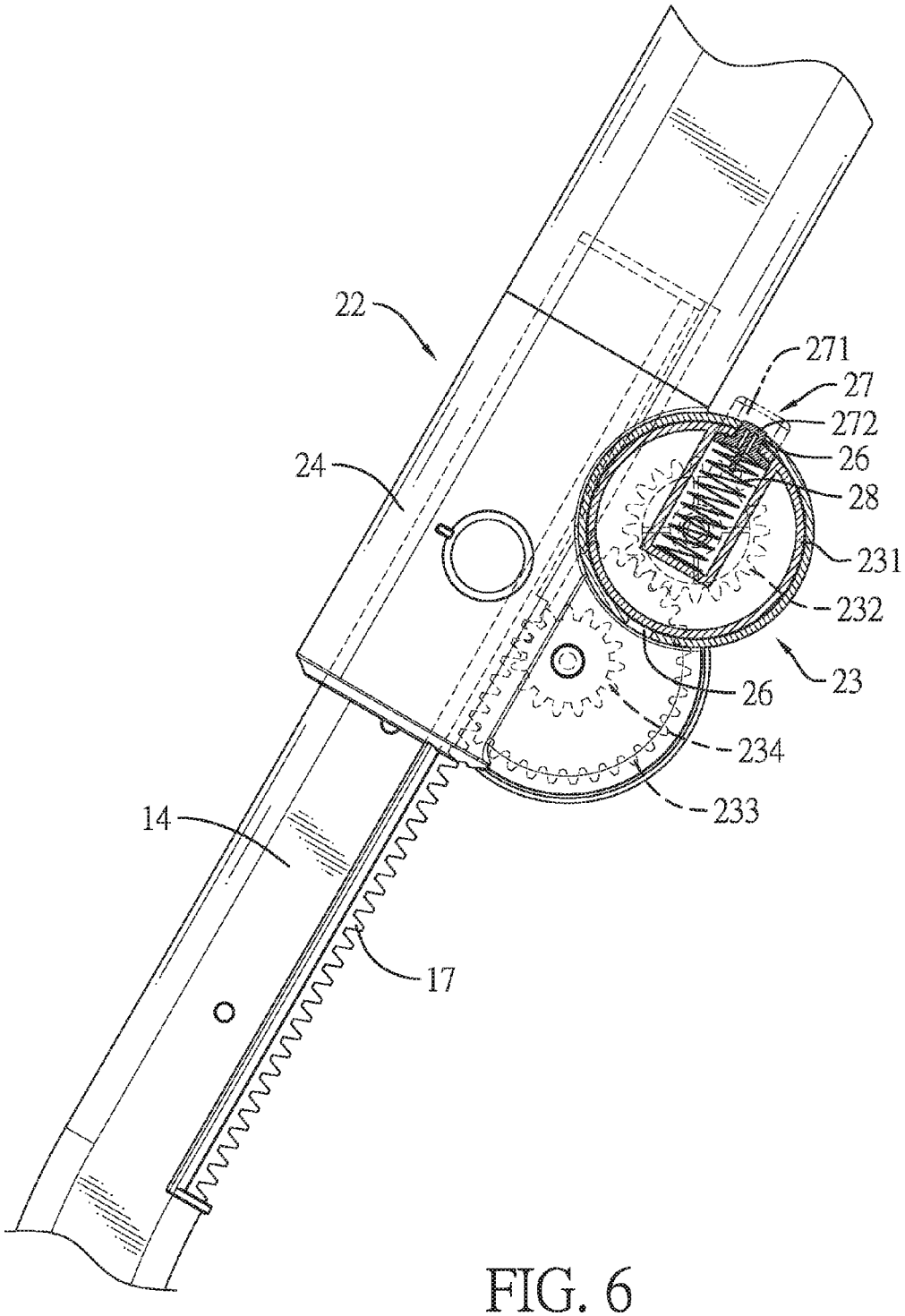
FIG. 6 is a side view in partial section of the supporting apparatus along line 6-6 in FIG. 5.

The frame 20 is moveably mounted between the legs 10. The frame 20 has a body 21, two moving seats 22 and two adjustment members 23. The moving seats 22 are mounted on the body 21 and the legs 10 are inserted into the moving seats 22 respectively. The adjustment members 23 are mounted on the moving seats 22 respectively and engage with the racks 17 of the legs 10 respectively. Each adjustment member 23 is rotatable and movable upward and downward along a corresponding one of the racks 17 of the legs 10. With reference to FIGS. 4 to 6, each adjustment member 23 has a rotating seat 231, a first gear 232, a second gear 233, and a third gear 234. The rotating seat 231 is rotatably mounted on a corresponding one of the moving seats 22 and has an inner surface. The first gear 232 is mounted on the inner surface of the rotating seat 231 and has a first external diameter. The second gear 233 is rotatably mounted in the corresponding one of the moving seats 22, engages with the first gear 232, and has a second external diameter. The third gear 234 is coactively mounted on a side surface of the second gear 233 and engages with a corresponding one of the racks 17 of the legs 10. The third gear 234 has a third external diameter. The second external diameter is longer than the first external diameter. The first external diameter is longer than the third external diameter.

With reference to FIG. 2, each moving seat has a housing 24 and a side cover 25. The housing 24 is mounted on the slanting portion 14 of a corresponding one of the legs 10. The side cover 25 is mounted on a side surface of the housing 24. The housing 24 has two notches 26. Each rotating seat 231 has a chamber 235, an outside surface, a first hole 236, a second hole 237, a button 27 and a first spring 28. The chamber 235 is formed in the rotating seat 231. The first hole 236 and the second hole 237 are formed in the outside surface of the rotating seat 231. The button 27 and the first spring 28 are mounted in the chamber 235 of the rotating seat 231. The button 27 has a first protrusion 271 and a second protrusion 272. The first protrusion 271 protrudes out of the first hole 236. The second protrusion 272 protrudes out of the second hole 237 and one of the two notches 26 of the housing 24 selectively. The first spring 28 has two ends connected to the rotating seat 231 and the button 27 respectively. With reference to FIG. 4, the frame 20 has a bar 29 and a board 291. The bar 29 is mounted between the two side covers 25. The board 291 is mounted on the bar 29.

Figure 9:
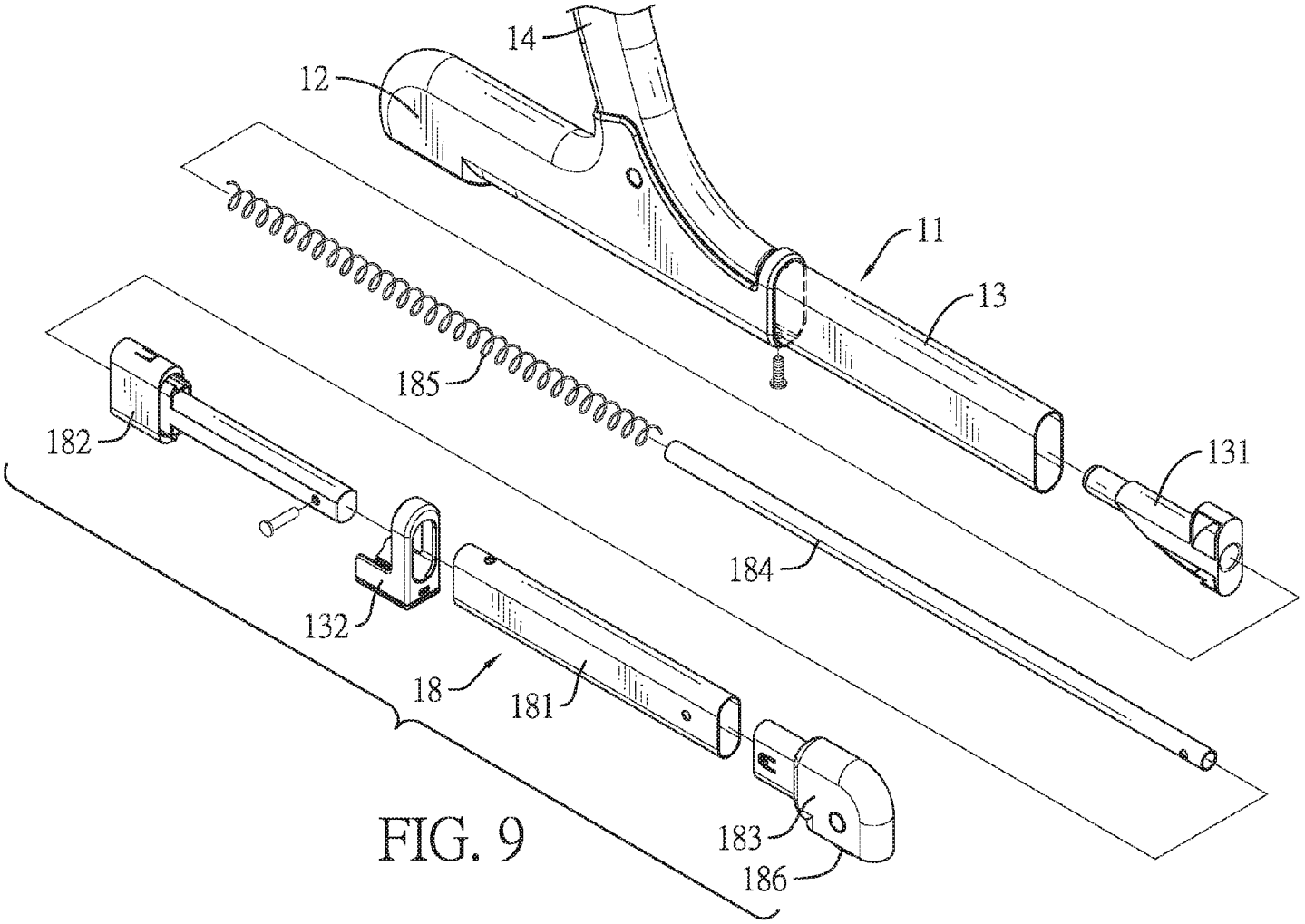
FIG. 9 is an enlarged exploded perspective view of an extension member of the supporting apparatus in FIG. 1.
Figure 10:
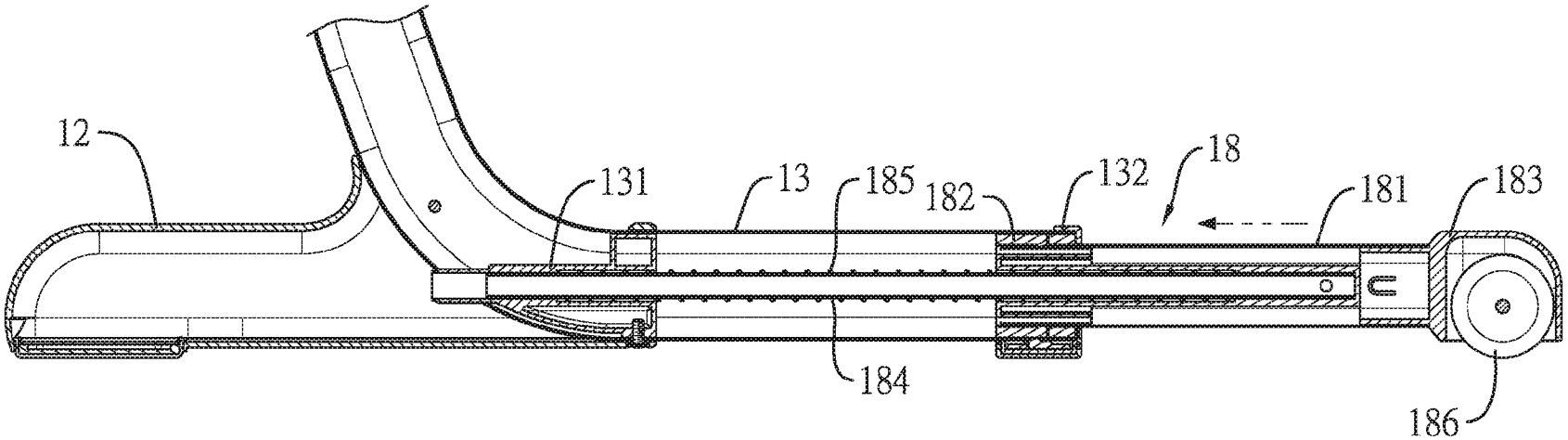
FIG. 10 is a side view in partial section of the extension member of the supporting apparatus in FIG. 1.

With reference to FIGS. 9 and 10, each transverse portion 13 has a first seat 131, a second seat 132 and an extension member 18. The extension member 18 has a tube 181, a positioning element 182, a fixing seat 183, a rod 184 and a second spring 185. The tube 181 is moveably mounted on the transverse portion 13 and has a first end and a second end. The positioning element 182 is mounted on the first end of the tube 181 and selectively abuts against the second seat 132. The fixing seat 183 is mounted on the second end of the tube 181. The rod 184 is mounted in the tube 181 and is inserted through the first seat 131. The second spring 185 is mounted on the rod 184 and is connected between the first seat 131 and the positioning element 182. Furthermore, each leg has a wheel 186. The wheel 186 is mounted on the fixing seat 183 of the extension member 18.

Figure 12:
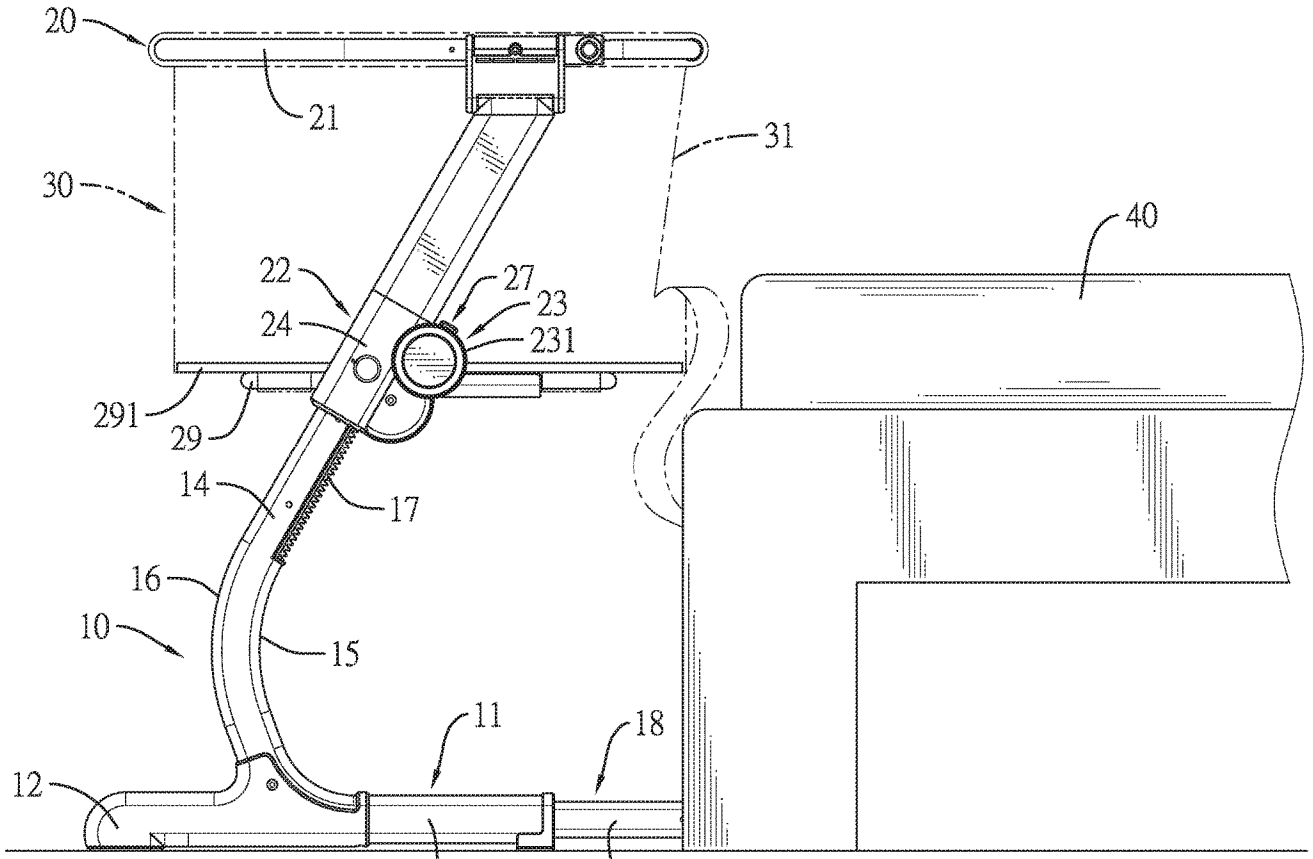
FIG. 12 is an operational side view of the supporting apparatus in FIG. 1 combined with an adult bed.

With reference to FIG. 12, a curtain 30 is mounted on the frame 20 of the supporting apparatus for a crib. The crib can be put on a side of an adult bed 40. The curtain 30 is opened to form an opening 31 that faces the adult bed 40. The height of a bed surface of the crib can be adjusted by the supporting apparatus to fit the height of a bed surface of the adult bed 40.

Figure 7:
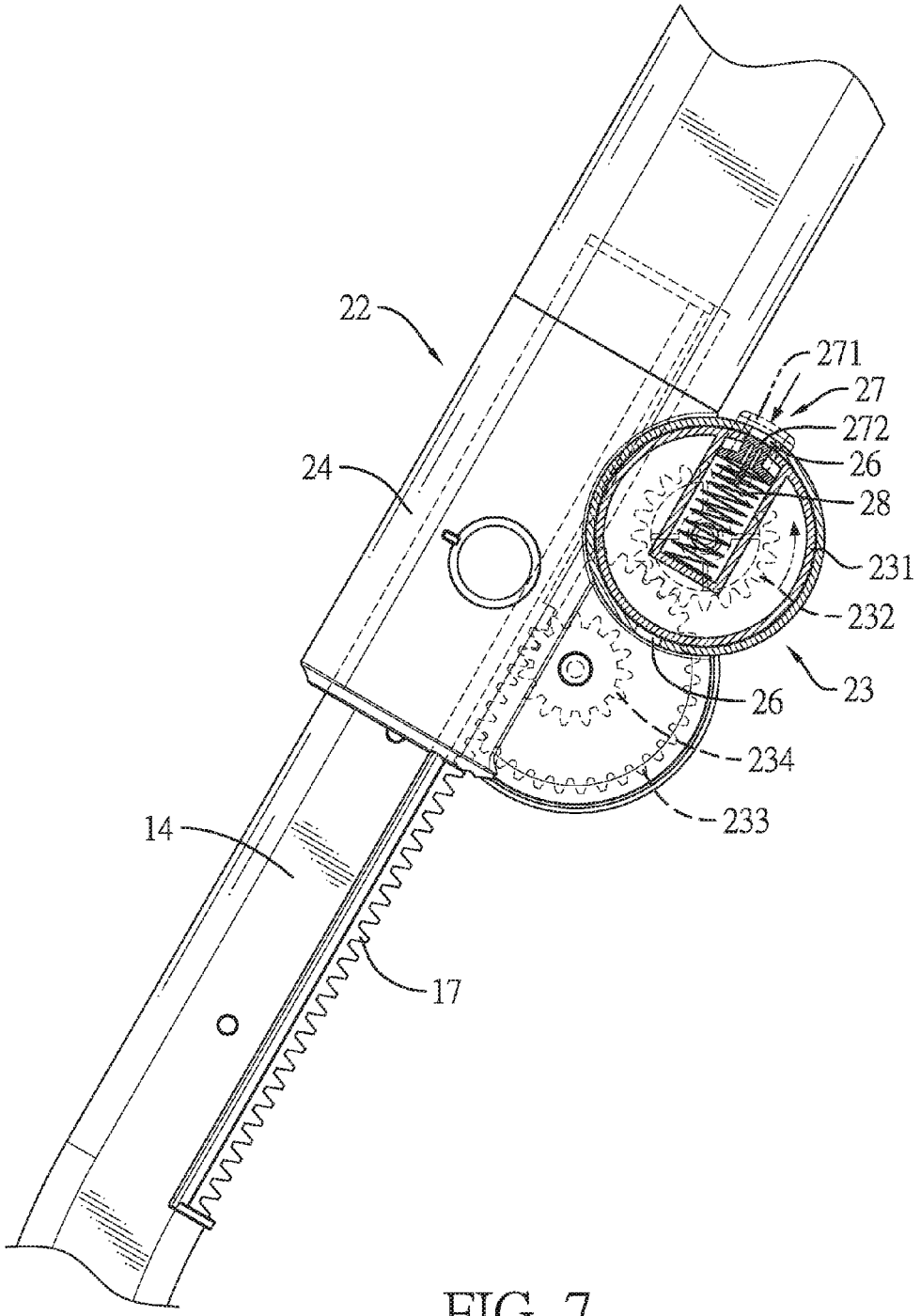
FIG. 7 is an operational side view in partial section of the supporting apparatus in FIG. 1 showing a button being pressed.
Figure 8:
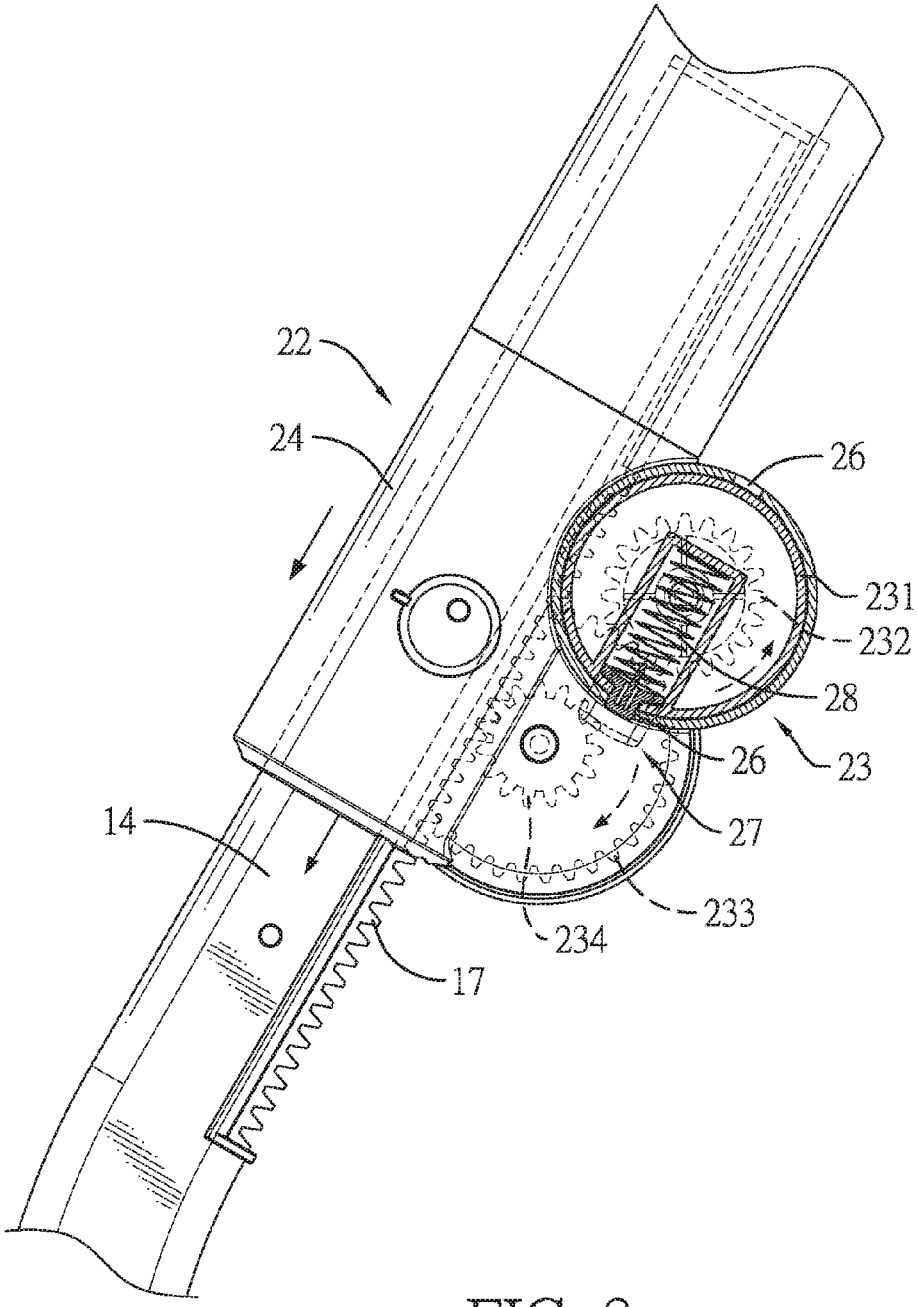
FIG. 8 is an operational side view in partial section of the supporting apparatus in FIG. 1 showing a moving seat being moved by an adjustment member.

With reference to FIG. 7, the button 27 of each adjustment member 23 is pressed, and the second protrusion 272 is moved away from one of the notches 26 of the moving seat 22. The rotating seat 231 can be rotated and the first gear 232 is rotated with the rotating seat 231. With reference to FIG. 8, the second gear 233 is rotated by the first gear 232. The third gear 234 is rotated with the second gear 233 and is rotated relative to and moves along the rack 17. The moving seat 22 and the adjustment member 23 are moved upward and downward along the rack 17.

With reference to FIGS. 10 and 12, the extension member 18 can be pulled and extend out of the transverse portions 13 to reinforce the stability of the supporting apparatus.

Accordingly, the adjustment members 23 of the frame 20 are respectively moved upward and downward along the racks 17 of the legs 10. The height of the bed surface of the crib is adjusted by the adjustment members 23 of the supporting apparatus to fit bed surfaces of adult beds 40 of various heights. The height of the bed surface of the crib is adjusted to be same as the height of the bed surface of the adult bed 40. Therefore, a baby moving between the crib and the adult bed 40 is safe.

In addition, the supporting fulcrum of each leg 10 of the supporting apparatus is located at the junction between the transverse portion 13 and the slanting portion 14 and is offset from the middle of the transverse portion 13. When the weight loaded on the supporting apparatus is diverged from the supporting fulcrum of the supporting apparatus, the supporting apparatus would not topple and is safe in use.

What is claimed is:

1. A supporting apparatus for a crib comprising:

two legs and each leg having a rack; and a frame moveably mounted between the legs and having a body;

two moving seats mounted on the body, and the legs inserted into the moving seats respectively; and two adjustment members mounted on the moving seats respectively and engaging with the racks of the legs respectively, each adjustment member being rotatable and moveable upward and downward along a corresponding one of the racks of the legs, and each adjustment member having a rotating seat rotatably mounted on a corresponding one of the moving seats and having an inner surface;

a first gear mounted on the inner surface of the rotating seat;

a second gear rotatably mounted in the corresponding one of the moving seats and engaging with the first gear; and a third gear coactively mounted on a side surface of the second gear and engaging with the corresponding one of the racks of the legs, wherein the second gear has an external diameter that is larger than an external diameter of the third gear.

2. The supporting apparatus for a crib as claimed in claim 1, wherein each moving seat has a housing mounted on a corresponding one of the legs; and a side cover mounted on a side surface of the housing.

3. The supporting apparatus for a crib as claimed in claim 2, wherein each housing has two notches; and each rotating seat has a chamber formed in the rotating seat;

an outside surface;

a first hole formed in the outside surface of the rotating seat;

a second hole formed in the outside surface of the rotating seat;

a button mounted in the chamber of the rotating seat and having a first protrusion protruding out of the first hole; and a second protrusion protruding out of the second hole and protruding out of one of the notches of the housing; and a first spring mounted in the chamber of the rotating seat and having two ends connected to the rotating seat and the button respectively.

4. The supporting apparatus for a crib as claimed in claim 1, wherein each leg has a first supporting member having a first supporting portion; and a second supporting portion on which the rack of the leg is mounted, and the second supporting portion having a bottom end connected to the first supporting portion.

5. The supporting apparatus for a crib as claimed in claim 2, wherein each leg has a first supporting member having a first supporting portion; and a second supporting portion on which the rack of the leg is mounted, and the second supporting portion having a bottom end connected to the first supporting portion.

6. The supporting apparatus for a crib as claimed in claim 3, wherein each leg has a first supporting member having a first supporting portion; and a second supporting portion on which the rack of the leg is mounted, and the second supporting portion having a bottom end connected to the first supporting portion.

7. The supporting apparatus for a crib as claimed in claim 4, wherein the first supporting portion has a transverse portion, and the second supporting portion has a slanting portion, the slanting portion is integrally connected to an end of the transverse portion and has a concave surface and a convex surface, and each leg has a second supporting member mounted on the transverse portion of the leg and protruding from the convex surface of the slanting portion of the leg.

8. The supporting apparatus for a crib as claimed in claim 5, wherein the first supporting portion has a transverse portion, and the second supporting portion has a slanting portion, the slanting portion is integrally connected to an end of the transverse portion and has a concave surface and a convex surface, and each leg has a second supporting member mounted on the transverse portion of the leg and protruding from the convex surface of the slanting portion of the leg.

9. The supporting apparatus for a crib as claimed in claim 6, wherein the first supporting portion has a transverse portion, and the second supporting portion has a slanting portion, the slanting portion is integrally connected to an end of the transverse portion and has a concave surface and a convex surface, and each leg has a second supporting member mounted on the transverse portion of the leg and protruding from the convex surface of the slanting portion of the leg.

10. The supporting apparatus for a crib as claimed in claim 7, wherein each transverse portion has a first seat mounted in the transverse portion; and a second seat mounted on another end of the transverse portion; and each leg has an extension member mounted on the transverse portion of the leg and having a tube moveably mounted on the transverse portion and having a first end and a second end;

a positioning element mounted on the first end of the tube and selectively abutting against the second seat;

a fixing seat mounted on the second end of the tube;

a rod mounted in the tube and inserted through the first seat; and a second spring mounted on the rod and connected between the first seat and the positioning element.

11. The supporting apparatus for a crib as claimed in claim 8, wherein each transverse portion has a first seat mounted in the transverse portion; and a second seat mounted on another end of the transverse portion; and each leg has an extension member mounted on the transverse portion of the leg and having a tube moveably mounted on the transverse portion and having a first end and a second end;

a positioning element mounted on the first end of the tube and selectively abutting against the second seat;

a fixing seat mounted on the second end of the tube;

a rod mounted in the tube and inserted through the first seat; and a second spring mounted on the rod and connected between the first seat and the positioning element.

12. The supporting apparatus for a crib as claimed in claim 9, wherein each transverse portion has a first seat mounted in the transverse portion; and a second seat mounted on another end of the transverse portion; and each leg has an extension member mounted on the transverse portion of the leg and having a tube moveably mounted on the transverse portion and having a first end and a second end;

a positioning element mounted on the first end of the tube and selectively abutting against the second seat;

a fixing seat mounted on the second end of the tube;

a rod mounted in the tube and inserted through the first seat; and a second spring mounted on the rod and connected between the first seat and the positioning element.

13. The supporting apparatus for a crib as claimed in claim 10, wherein each leg has a braking caster mounted on the second supporting member; and a wheel mounted on the fixing seat of the extension member.

14. The supporting apparatus for a crib as claimed in claim 11, wherein each leg has a braking caster mounted on the second supporting member of the leg; and a wheel mounted on the fixing seat of the extension member of the leg.

15. The supporting apparatus for a crib as claimed in claim 12, wherein each leg has a braking caster mounted on the second supporting member of the leg; and a wheel mounted on the fixing seat of the extension member of the leg.

* * * * *